US007736095B2

(12) United States Patent
Fujita

(10) Patent No.: US 7,736,095 B2
(45) Date of Patent: Jun. 15, 2010

(54) PILE ASSEMBLY FOR ENGINEERING AND CONSTRUCTION WORKS

(76) Inventor: Yasuhiro Fujita, 22-34, Motomiya 2-Chome, Morioka-Shi, Iwate 020-0866 (JP)

( * ) Notice: Subject to any disclaimer, the term of this patent is extended or adjusted under 35 U.S.C. 154(b) by 572 days.

(21) Appl. No.: 10/567,599

(22) PCT Filed: Jan. 21, 2004

(86) PCT No.: PCT/JP2004/000492

§ 371 (c)(1),
(2), (4) Date: Feb. 9, 2007

(87) PCT Pub. No.: WO2005/014939

PCT Pub. Date: Feb. 17, 2005

(65) Prior Publication Data

US 2007/0214735 A1 Sep. 20, 2007

(30) Foreign Application Priority Data

Aug. 6, 2003 (JP) ..... 2003-206214

(51) Int. Cl.
*E02D 5/80* (2006.01)

(52) U.S. Cl. ..... 405/244; 405/251; 405/253; 405/245; 405/246; 405/232; 269/8

(58) Field of Classification Search ..... 405/231, 405/232, 235, 242, 244, 251, 252.1, 253, 405/239, 245, 246, 249; 29/428, 432, 432.1, 29/432.2, 464, 468, 423; 269/8; 138/108, 138/112, 113

See application file for complete search history.

(56) References Cited

U.S. PATENT DOCUMENTS

| | | | | | |
|---|---|---|---|---|---|
| 3,033,144 | A | * | 5/1962 | Schmidt | 269/8 |
| 3,487,646 | A | * | 1/1970 | Gatien | 405/257 |
| 4,405,262 | A | * | 9/1983 | Nagashima | 405/221 |
| 5,746,638 | A | * | 5/1998 | Shiraishi | 446/92 |
| 5,975,808 | A | * | 11/1999 | Fujita | 405/244 |

FOREIGN PATENT DOCUMENTS

| | | |
|---|---|---|
| JP | 59-96327 | 6/1984 |
| JP | 06-123933 | 12/1995 |
| JP | 11-098173 | 11/1999 |
| JP | 2000-000819 | 7/2001 |
| JP | 2001-144256 | 11/2002 |

* cited by examiner

*Primary Examiner*—David J Bagnell
*Assistant Examiner*—Sean D Andrish
(74) *Attorney, Agent, or Firm*—Leighton K. Chong

(57) ABSTRACT

A conventionally available pile for civil engineering work is constructed such that the pile has in its inside a core body with wedges that stick into soil deep in the ground and function to prevent the pile from coming out of place. A problem exists with such a pile in that placing the core body at an appropriate position inside the pile is difficult. A pile for civil engineering work of this invention enables a core body to be placed at an appropriate position and labor required for the placement to be reduced. A pile (1) for civil engineering work is characterized in that, for example, a guide rail (4) that enables a core body (6) to be guided is provided inside a body of the pile (1), the core body (6) is guided through the guide rail (4), and wedges (6*a*, 6*b*) are appropriately guided to cut/pushed-in openings (2*a*, 2*b*, 3*a*, 3*b*).

17 Claims, 15 Drawing Sheets

PILE ASSEMBLY FOR ENGINEERING AND CONSTRUCTION WORKS

FIELD OF THE INVENTION

The present invention relates to a pile assembly used for engineering and construction works such as shore protection, road construction, foundation work for architecture and engineering. In particular, the present invention relates to a pile assembly for engineering, mounting therein a core member with wedge members.

DESCRIPTION OF RELATED ART

Prior art engineering work piles having various shapes and sizes have been used. Most of these piles are made of concrete or steel. Most popular engineering work piles are formed into cylindrical-cone shapes or columns. When these engineering piles are used for protection of river, sea shore or roads, the piles are obliquely or vertically driven into the earth. This is also applied for the working for architectures. However, when the piles for engineering work are driven into soft ground, there are drawbacks that they sway and are unstable or even removed. In case of hard ground, there are drawbacks that the piles may away or be lifted after the lapse of time. Furthermore, the prior art piles for construction work have a poor resistance to earthquake. If the piles that sway and are unstable or lifted are used in engineering work, work itself is dangerous as well as the working cite even after completion of work. Hence, in order to improve such drawbacks and inconveniences, piles for engineering works that can maintain better stabilization in the earth are invented, and an example of such improved pile is disclosed in the official gazette of Japanese Patent Application No. 11-323923.

In Japanese Patent Application No. 11-323923, a pile or pile assembly is disclosed comprising a leading pile and a coupling pile with a plurality of openings formed in the sidewall thereof respectively, and in said piles, a core assembly with a plurality of wedge members are mounted so as to latch the tips of said wedge members to the edge of said openings.

However, with such conventional art, there existed a problem that it was difficult to arrange the position of the core assembly at an appropriate spot within the pile. That is to say that when the core assembly is positioned at an appropriate spot within the pile, tips of a plurality of wedge members mounted on the sore assembly should come adjacent to internal side of the openings formed in the sidewall of each pile. By pushing down the core assembly in such state while guiding the tip of each wedge member to open radially outward, the wedge members are projected from the piles.

The difficulty of positioning the core assembly at an appropriate spot within the pile concerns the length of the pile itself. Normally, a pile used for engineering works is a steel pipe with a diameter of 20 to 30 cm and a length of 5 to 6 m, or more. Further to above, the openings formed at according positions on the sidewall of steel pipe are normally situated more than 3 m apart from the opening of the pipe, and more than one, for example 8, openings are provided. The process concerns inserting wedge members of 80 cm in length respectively to such small openings at once, but the way such process are accomplished is no more than a blind-folded state, and it should be done by intuition of the workman. Accordingly, it required more than 2 workmen, and consumed over 15 to 20 minutes to construct a single pile.

Therefore, there was an urgent need for modification and simplification of such construction concerning difficulties. Furthermore, in order to make a larger pile, each component should be enlarged accordingly, which makes it even harder for the wedge members to be projected from the pile.

It is therefore an object of the present invention to provide a pile or pile assembly employed in engineering and construction works which is able to position a core assembly at an appropriate spot within the pile more easily. It is further an object of the present invention to provide tools and methods adapted for constructing such pile.

SUMMARY OF THE INVENTION

In order to accomplish the above-mentioned object, the invention provides a pile assembly employed in engineering and construction works comprising a pointed leading member subsequently mounted at one end; a pile body formed in a hollow column; a sidewall having a plurality of openings; and a core assembly having a plurality of wedge members mounted within said column, wherein a guide rail allowing the guide of said core assembly is provided within said pile assembly, wherein said core assembly is guided via said guide rails to appropriately lead the tips of said wedge members to said openings.

With such feature, it becomes possible to provide a pile assembly to position the core assembly at an appropriate spot within the pile.

Further, in order to accomplish the above-mentioned object, the invention provides a pile assembly formed by splicing together the pile body divided in more than 2 portions, with said core assembly provided in each of said divided pile body portion.

With such feature, a pile assembly made from a plurality of pile body portions can be provided, which means that various types of pile assembly with different length can be provided.

Further, in order to accomplish the above-mentioned object, the invention provides a pile assembly in which a plurality of said guide rails are provided so as to extend across said divided pile body portions within said pile body.

With such feature, it becomes possible to position said core assembly at an appropriate spot within said pile assembly even when the pile assembly is formed of a plurality of pile body portions.

Further, in order to accomplish the above-mentioned object, the invention provides a pile assembly in which a plurality of said guide rails are provided in each of said divided pile body portions.

With such feature, it becomes possible to position said core assembly at an appropriate spot within said divided pile body portion.

Furthermore, in order to accomplish the above-mentioned object, the invention provides a pile assembly in which said openings are formed as incised apertures being opened by exertion of outer force, wherein at least the lower edge portions of tongue-shaped pieces of said opened apertures are connected to said pile body, while said tongue-shaped pieces constitute slopes.

With such feature, it becomes possible for appropriately positioned said wedge members of said core assembly to project out of the pile body properly via said slopes.

Furthermore, in order to accomplish the above-mentioned object, the invention provides a pile assembly further provided with a spiral blade for digging soil on outer wall thereof for facilitating said pile assembly to be penetrated in the earth.

With such feature, it becomes possible to bury said pile assembly properly underground, and it is possible to support the buried pile assembly by such spiral blade.

Furthermore, in order to accomplish the above-mentioned object, the invention provides a pile assembly in which said pointed leading member is provided with an excavating component.

With such feature, it becomes possible to excavate the earth appropriately and to bury said pile assembly therein.

Furthermore, in order to accomplish the above-mentioned object, the invention provides a pile assembly in which said wedge members are formed to have length different from the length of wedge members adjacent thereto.

With such feature, it becomes possible for said wedge members to be projected from said pile body at different level to more securely retain said pile assembly underground.

Furthermore, in order to accomplish the above-mentioned object, the invention provides a pile assembly in which the cross-sectional shape of said pile assembly is designed to be either circular or rectangular.

With such feature, it becomes possible to provide a pile assembly suited to various installation locations.

Furthermore, in order to accomplish the above-mentioned object, the invention provides a pile assembly in which said wedge members are mounted on said core assembly by components, such as hinges, capable of changing angles at corresponding position with said openings.

With such feature, it becomes possible for the wedge members to project out of the pile body without bending.

Second invention of the present application relates to a magnet cross gauge provided with magnets employed in manufacture of said pile assembly.

Hence, in order to accomplish the above-mentioned object, the invention provides a magnet cross gauge provided with magnets employed in manufacturing of said assembly, wherein said magnet cross gauge allows an insertion of a plurality of said guide rails in said pile assembly while maintaining said guide rails in parallel with respect to one another, wherein further capable of fixing said guide rails onto the inner wall of said pile body in parallel with respect to one another, and being taken out of the said pile while said guide rails remaining on the inner wall of said pile body thereafter.

With such feature, it becomes possible to provide a tool suitable for manufacturing of said pile assembly, and further to mount said guide rails appropriately within said pile assembly. It further enables said guide rails to be mounted by the hands of only 1 workman, and further reduces labor and time required in constructing said pile assembly.

Further, in order to accomplish the above-mentioned object, the invention provides a magnet cross gauge further comprising a first magnet cross gauge member provided with a plurality of recesses on its periphery enabling said guide rails to be held therein, magnets mounted adjacent to said recesses and a handle attached on one side thereof; bar members fixed to said first magnet cross gauge member; and a second magnet cross gauge member mounted to be movable or unmovable to said bar members while provided with a plurality of recesses on its periphery enabling said guide rails to be held therein and magnets mounted adjacent to said recesses.

With such feature, it makes it possible to fix a plurality of said guide rails appropriately within said pile assembly.

Third invention of the present application relates to a method for fixing said guide rails within said pile body by employing said magnet cross gauge.

Hence, in order to accomplish the above-mentioned object, the invention provides a method for fixing said guide rails within said pile body by employing said magnet cross gauge comprising a step to maintain a plurality of said guide rails in parallel with respect to one another by employing said magnet cross gauge; a step to determine the position of said guide rails within said pile body after inserting said guide rails maintained in parallel to one another within said pile body; a step to fix each of said guide rails to the inner wall of said pile body; and a step to take out only said magnet cross gauge from within said pile body while having said guide rails remain fixed to the inner wall of said pile body.

With such feature, it becomes possible to provide a method for a plurality of said guide rails to be fixed within said pile body at once with swiftness and accuracy.

Further, in order to accomplish the above-mentioned object, the invention provides a method for fixing said guide rails within said pile body in which said pile body is comprised of more than 2 pile body portions, wherein said method for fixing said guide rails within said pile body is provided with a step to splice together said pile body portions performed prior thereto.

With such feature, it becomes possible to provide a pile assembly even with long length by splicing together pile body portions with short length.

Further, in order to accomplish above-mentioned object, the invention provides a method for fixing said guide rails within said pile body in which said pile body is comprised of more than 2 of said pile body portions, wherein said method for fixing said guide rails within said pile body is performed to more than 2 said pile body portions respectively.

With such feature, it becomes possible to fix a plurality of said guide rails to the pile body portions of short length at once with swiftness and accuracy.

Fourth invention of the present application relates to a method for manufacturing said pile assembly.

Hence, in order to accomplish the above-mentioned object, the invention provides a method for manufacturing said pile assembly comprising a step to fix said guide rails on the inner wall of said pile body either before or after said openings are formed on the sidewall of said pile body, and a step to guide said core assembly provided with a plurality of wedge members with individual tips formed in acute angle within said pile body by employing said guide rails, and to position said core assembly so that the tip of said wedge members are placed adjacent to said openings.

With such feature, it becomes possible to provide a suitable method to manufacture said pile assembly.

Further, in order to accomplish the above-mentioned object, the invention provides a method for manufacturing said pile assembly in which said pile assembly is comprised of more than 2 of said pile body portions, wherein said method for manufacturing said pile assembly includes a step to splice together said pile body portions before fixing said guide rails onto the inner wall of said pile body, wherein said step to fix said guide rails to the inner wall of said pile body is to install said guide rails so as to extend across a plurality of said body portions spliced together.

Furthermore, in order to accomplish the above-mentioned object, the invention provides a method for manufacturing said pile assembly in which said pile body is comprised of more than 2 of said pile body portions, wherein said step to position the tip of said wedge members to be adjacent to said openings are performed to each of said pile body portions, wherein a step to splice together said pile body portions each provided with said core assembly is performed subsequent thereto.

Furthermore, in order to accomplish the above-mentioned object, the invention provides a method for manufacturing said pile assembly comprising a step to fix a pointed leading member formed in a shape of cone or pyramid at one end of said pile assembly after performing said steps to fix said guide rails.

BRIEF DESCRIPTION OF THE DRAWINGS

The present invention will be described by way of embodiments with reference to drawings.

DESCRIPTION OF THE PREFERRED EMBODIMENTS

Now, the first embodiment of a pile assembly for engineering and construction works related to the first invention of the present application will be described in detail, showing the components thereof and their relations based on the drawings.

Figure 1:
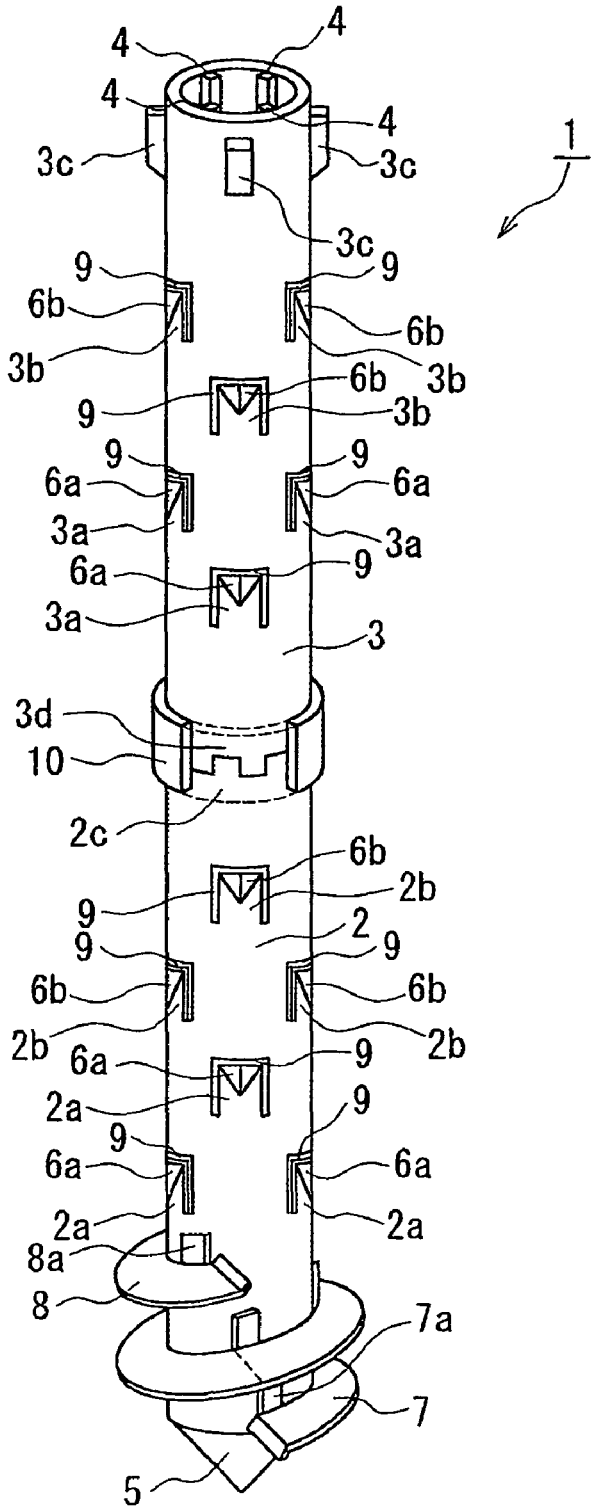
FIG. 1 is a perspective view showing the first embodiment of a pile assembly related to the first invention of the present application.

As shown in FIG. 1, a pile assembly for engineering and construction works 1 comprises a leading pile 2, a coupling pile 3, guide rails fixed within said leading pile 2 and coupling pile 3, a pointed leading pile 5, a core assembly, a leading and excavating spiral blade 7 and a coupling spiral blade 8.

In the present embodiment, a body of the pile assembly 1 is made up of the leading pile 2 with none to multiple coupling pile(s) 3 fixed thereto. With such feature, it is possible to provide a pile assembly of various lengths. As a matter of course, the present invention includes comprising the pile assembly 1 with only one body portion, in detail, by elongating the length of the leading pile 2. In such case, a single or multiple core assembly(s) 6 is mounted to a single pile assembly 1.

The leading pile 2 is made of a steel pipe in a shape of hollow column. The leading pile 2 is further provided with 8 openings 2*a*, 2*b* that are divided in 2 groups, upper and lower, and a splice 2*c*. To form the openings 2*a* and 2*b*, 3 sides are incised leaving only the lower edge portions connected to the pile body respectively. Subsequently, tongue-shaped pieces are bent inward at the connected lower edge portions by exerting an inward force from outside. As a result, the tongue-shaped pieces which were bent inward constitute slopes for wedge members 6*a*, 6*b* to project out of the pile body.

However, where the 3 sides of the openings 2*a*, 2*b* are incised in the leading pile 2 will become fragile. Hence those parts are preferred to be fitted with reinforcing frames for reinforcement. On the leading pile 2, 2 openings 2*a*, 2*b* are formed collinear to one another in longitudinal direction, whereas adjacent openings 2*a*, 2*b* are formed at different level with one another while having the same level with the openings next to the adjacent ones in circumferential direction (refer FIG. 1).

The overall summary of the coupling pile 3 is the same as the leading pile 2. The coupling pile 3 is also made of a steel pipe in a shape of hollow column. The coupling pile 3 is further provided with 8 openings 3*a*, 3*b* that are divided in 2 groups, upper and lower, an aboveground projection 3*c* and a splice 3*d*. As already mentioned above, upon constructing the pile body of the pile assembly by splicing together more than 2 coupling piles 3, coupling piles 3 having splices 3*d* provided at both upper and lower ends thereof with the aboveground projection 3*c* removed are used.

The openings 3*a*, 3*b* are formed in the same way as the openings 2*a*, 2*b*. In the preferred embodiment as shown in the drawing, the openings 2*a*, 2*b* formed on the leading pile 2 and the openings 3*a*, 3*b* formed on the coupling pile 3 are placed collinear to one another in longitudinal direction of the pile assembly 1. These openings can of course be placed offset to one another in circumferential direction. From such feature, the pile assembly 1 is expected to possess greater rooting ability exerted to the whole circumferential area thereof, which leads to an enhancement of stability. The aboveground projection 3*c* functions to facilitate the rotary drive upon burying the pile assembly 1 in the earth.

Further to above, the present invention includes not only to manufacture the leading pile 2 and the coupling pile 3 from steel pipes of circular section, but also to manufacture them from hollow components with rectangular or polygonal sections. Further, the present invention includes not only to use steel but also to use aluminum alloy, titanium alloy and synthetic-resin in manufacturing the components. Furthermore, the number of openings 2*a*, 2*b* and 3*a*, 3*b* of the leading pile 2 and the coupling pile 3 are not limited to 8, and the number can be chosen optionally so long as it is multiple. Of course, the number of the openings can be odd number instead of even number. In the present embodiment, the process of forming the openings, in other words to incise the 3 sides leaving only the lower edge portions connected to the pile body is done in advance, and the folding of the tongue-shaped pieces are done subsequently at a predetermined timing. However, the present invention also includes forming the openings in rectangular shape in advance, and to attach slope components at the openings from outside instead. Further, the present invention also includes placing the openings nonlinear to one another in the longitudinal direction of the leading pile 2 and the coupling pile 3. The present invention also includes placing the adjacent openings 2*a*, 2*b* and 3*a*, 3*b* in a same horizontal plane perpendicular to the longitudinal direction of the leading pile 2 and the coupling pile 3. Furthermore, the present invention does not limit the leading pile 2 and the coupling pile 3 to have the basic compositions as above.

In the present embodiment, a pile body which is a body portion of the pile assembly 1 is made up of a single leading pile 2 and a single coupling pile 2. The leading pile 2 and the coupling pile 3 constitute the pile body of the pile assembly 1 by engaging respective splices 2*c* and 3*d* formed with indentations to connect with one another, and welding the engaged section accordingly. To protect the said engaged section, a connection collar is mounted thereon. However, the present invention also includes forming the leading pile 2 and the coupling pile 3 as a single pile body by depositing the components to one another. As mentioned above, the present invention includes connecting a plurality of coupling piles 3 to the leading pile 2. Further, the present invention also includes not welding the engaged section of splices 2*c*, 3*d*. In the present embodiment, the leading pile 2 and the coupling pile 3 is formed in same length as well as same diameter. However, the present invention includes those components to be formed with different length and diameter.

Now, a guide rail 4 which is fixed within the leading pile 2 and the coupling pile 3 will be described. The guide rail 4 is made from steel material with magnetic property adhesive to magnets, and formed with rectangular cross section. The guide rail 4 has a length of the leading pile 2 and the coupling pile 3 added.

The present invention includes guide rail 4 with circular or polygonal cross sections instead of rectangular. Further, the guide rail 4 can be made not only of steel, but also of aluminum alloy, titanium alloy and synthetic resin. In the present embodiment, the guide rail 4 is to have the same length as the leading pile 2 and the coupling pile added up, but of course the guide rail 4 can be fixed to respective components. In other words, the present invention also includes 4 guide rails 4 to be mounted to each of the leading pile 2 and the coupling pile 3, employing 8 guide rails in total. The present invention does not limit the number of guide rails 4 to be mounted. Upon mounting the guide rails 4 to the leading pile 2 and the coupling pile 3 independently, the same guide rails 4 can be used. In such case, it is preferable to form the guide rails 4 with length slightly shorter than the respective length of the leading pile 2 and the coupling pile 3. This is taking into account the parts engaged to the leading pile 2 and the coupling pile 3 and the parts to be engaged the pointed leading member 5.

The present invention includes making the guide rails 4 from different materials from the leading pile 2 and the coupling pile 3. However, it is preferable to have the leading pile 2, the coupling pile 3 and the guide rails 4 to be all made from the same material to facilitate the reciprocal engagement. Further, since it is preferable that the guide rails 4 be made from material having magnetic property, the guide rails 4 are to possess magnetic material in one part upon making the guide rails 4 of materials without magnetic property.

Now, a tool for fixing the guide rails 4 within the leading pile 2 and/or the coupling pile 3 will be described, as well as an assembling method of the pile assembly 1 employing the said tool.

Firstly, a magnet cross gauge 40 which acts as said tool will be described. 4 guide rails 4 are placed with magnet cross gauge 40 placed at 90° angle respectively from the center line of the 4 guide rails while aligned in parallel to one another (refer FIG. 2).

Figure 3:
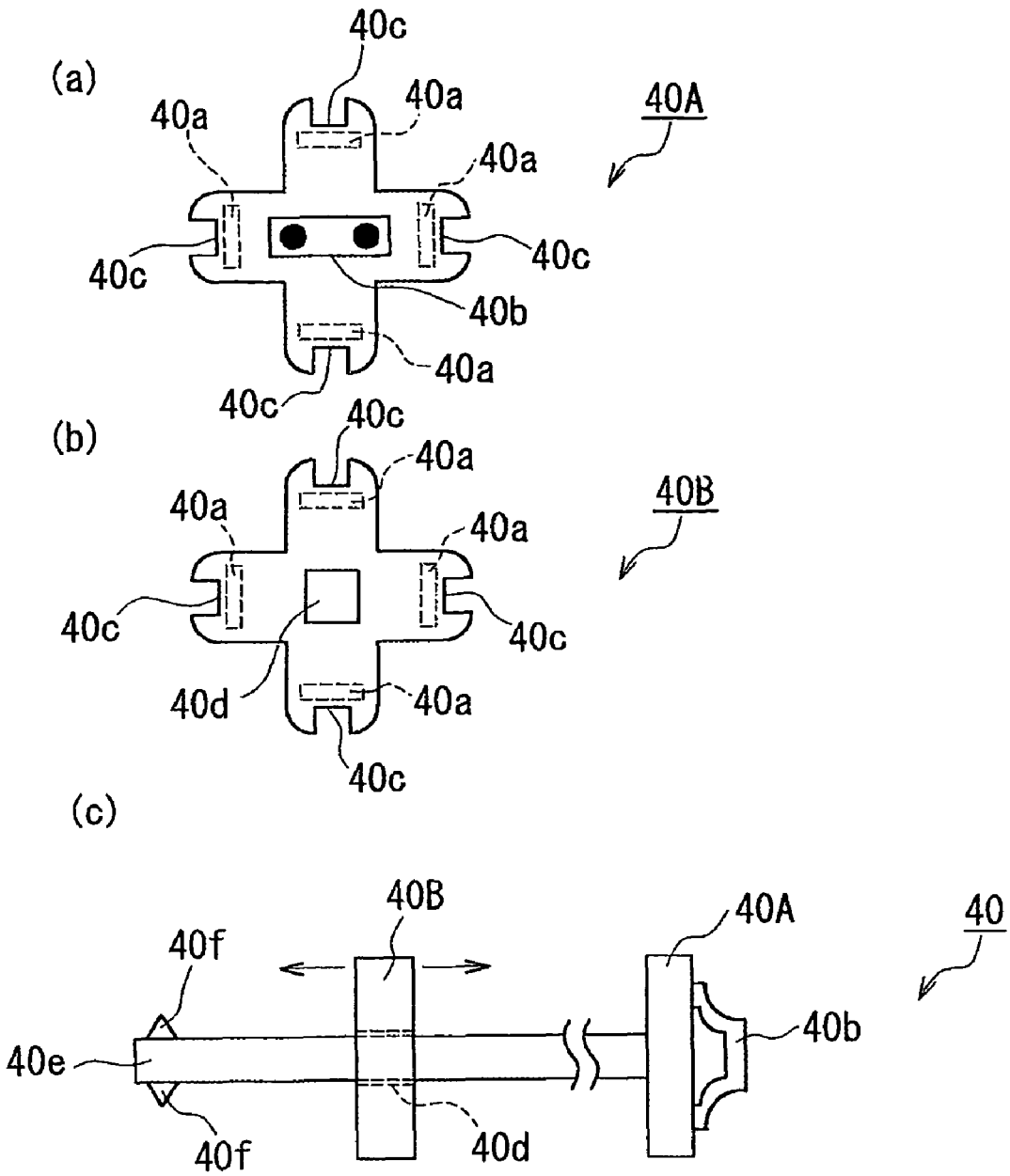
FIG. 3 is a explanatory drawing showing the components as well as their relations that constitute the magnet cross gauge as disclosed in FIG. 2, and (a) is a plane view of a magnet cross gauge member which functions as a supporting component, (b) is a plane view of a magnet cross gauge member which functions as a linking component, and (c) is a front view of the magnet cross gauge showing the relation of the magnet cross gauge members as disclosed in (a) and (b)

Said magnet cross gauge is disclosed in FIG. 3. A magnet cross gauge member 40A is shown in FIG. 3(*a*), a magnet cross gauge member 40B is shown in FIG. 3(*b*) and relation of the magnet cross gauge member 40A and 40B is shown in FIG. 3(*c*).

The magnet cross gauge member 40A in FIG. 3(*a*) is provided with 4 magnets 40*a*, a handle 40*b* and 4 recesses 40*c*, whereas the magnet cross gauge member 40B in FIG. 3(*b*) is provided with 4 magnets 40*a*, 4 recesses 40*c* and a hole 40*d*. The magnets 40*a* are provided adjacent to the respective recesses 40*c* of the magnet cross gauge member 40A and 40B. With such feature, it enables to attract the guide rails 4 made from magnetic steel material and have them held within the recesses 40*c*. The handle 40*b* functions to allow the movement of the magnet cross gauge 40 in the state as depicted in FIG. 2. The recesses 40*c* are shaped so as to supplement the guide rails 4, and to appropriately hold the guide rails 4 therein. The hole 40*d* is formed in rectangular shape, and a rectangular member 40*e* is inserted therein. One end of the rectangular member 40*e* is fixed to the magnet cross gauge member 40A at the center of a plane opposite the handle 40*b* by junction.

The magnet cross gauge member 40B is movable in the axial direction of the rectangular member 40*e* (refer FIG. 3(*c*)). However, to avoid the magnet cross gauge member 40B to be disengaged accidentally from the rectangular member 40*e*, a projection 40*f* is provided at one end of the rectangular member 40*e* (refer FIG. 3(*c*)). Since the projection 40*f* is designed to be stored within the rectangular member 40*e* upon intentional exertion of force above predetermined level, it is possible to disengage the magnet cross gauge member 40B from the rectangular member 40*e*.

The shape of the handle 40*b* is not limited in the present invention so long as it allows the movement of the guide rails 4 with their proportional position maintained. Further, the present invention does not limit the shape of the recesses 40*c* to be supplementary to the guide rails 4, and the shapes other than rectangle, such as circular or polygonal shaped recesses are also included in its scope. However, the recesses 40*c* are required to appropriately hold the guide rails 4 therein. Although the hole 40*d* is formed in rectangular shape so as to correspond to the cross-sectional shape of the rectangular member 40*e* in the present embodiment, the shape can be circular or polygonal so long as the recesses 40*c* of the respective magnet cross gauge member 40A and magnet cross gauge member 40B are maintained in the corresponding position. Further, the present invention does not limit the end of the rectangular member 40*e* to be fixed at the center of a plane opposite the handle 40*b* by junction. As long as the components may be employed in a same way as being junction fixed upon use, any fixing method can be employed. Further, the present invention also includes having the rectangular member 40*e* non-removable from the projection 40*f*. The present invention further includes having a pair of magnet cross gauge member 40A and 40B in a single component, as well as having more than 3 magnet cross gauge members combined together.

Now, a method for fixing the guide rails 4 within the pile body by employing the above magnet cross gauge 40 will be described.

In the above-mentioned preferable embodiment of the present invention, a pile assembly 1 is comprised of a leading pile 2 and a coupling pile 3. There are mainly 2 ways in performing the method, a way to assemble the core assembly 6 after splicing together the leading pile 2 and the coupling pile 3, and a way to assemble the core assembly 6 prior to the splicing of the 2 components.

Firstly, a method for fixing the guide rails 4 within the pile body employing the magnet cross gauge 40 in case of assembling the core assembly after splicing together the leading pile 2 and the coupling pile 3 will be described.

First of all, the leading pile 2 and the coupling pile 3 are spliced at the respective splices 2*c* and 3*d*, and the 2 components are fixed, for example, by welding. Next, 4 guide rails 4 are placed with the magnet cross gauge 40 at 90° angle respectively from the center line of the 4 guide rails while aligned in parallel to one another (refer FIG. 2). The length of the 4 guide rails 4 is to be the same length as the pile body of the pile assembly 1. Then, with such state maintained, the 4 guide rails 4 are inserted within the pile body in places not matching where the openings 2*a*, 2*b*, 3*a*, 3*b* are formed. Each guide rails 4 are welded onto necessary spots of the inner wall of the pile body in such state. Lastly, the magnet cross gauge 40 is removed from the pile body by pulling it by the handle 40*b*. With such method, it becomes possible to fix the guide rails 4 onto the inner wall of the pile body precisely without difficulty. The incisions for the openings 2*a*, 2*b*, 3*a*, 3*b* can be formed at any time either before or after any of the above steps.

Now, a composition of the core assembly 6 assembled within the pile body will be described.

Figure 4:
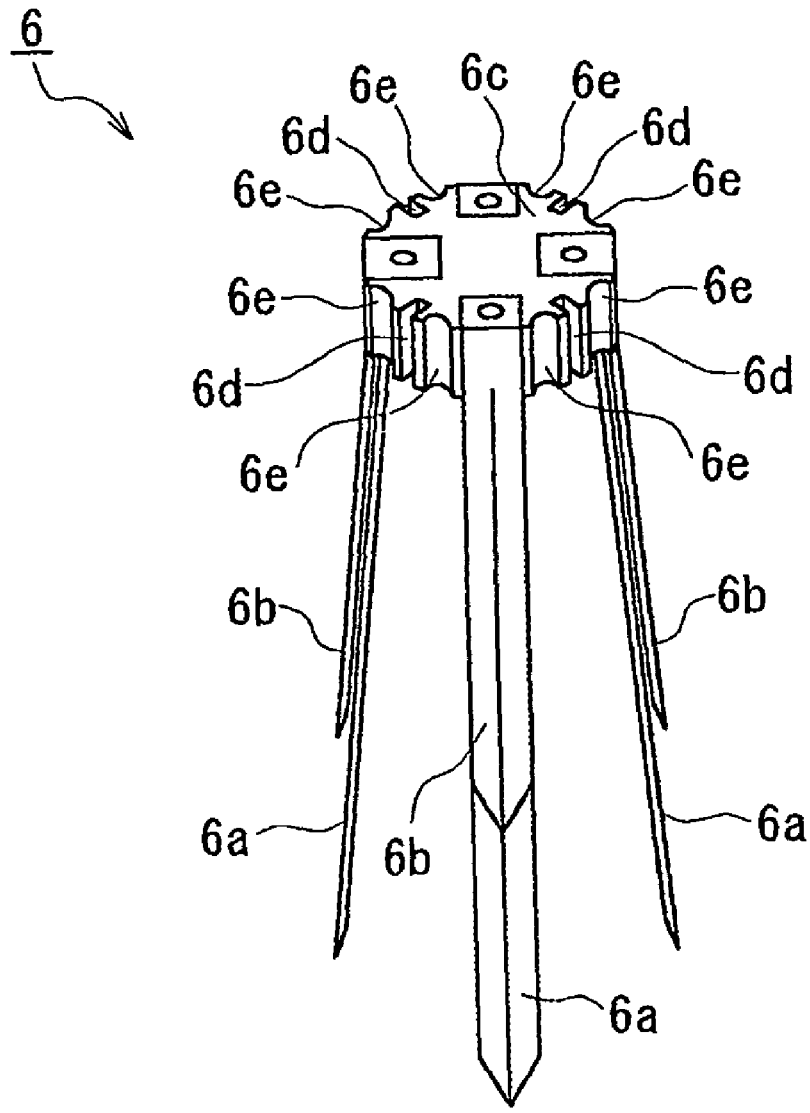
FIG. 4 is a perspective view showing a core assembly mounted on a leading pile which constitutes the pile assembly as disclosed in FIG. 1.
Figure 5:
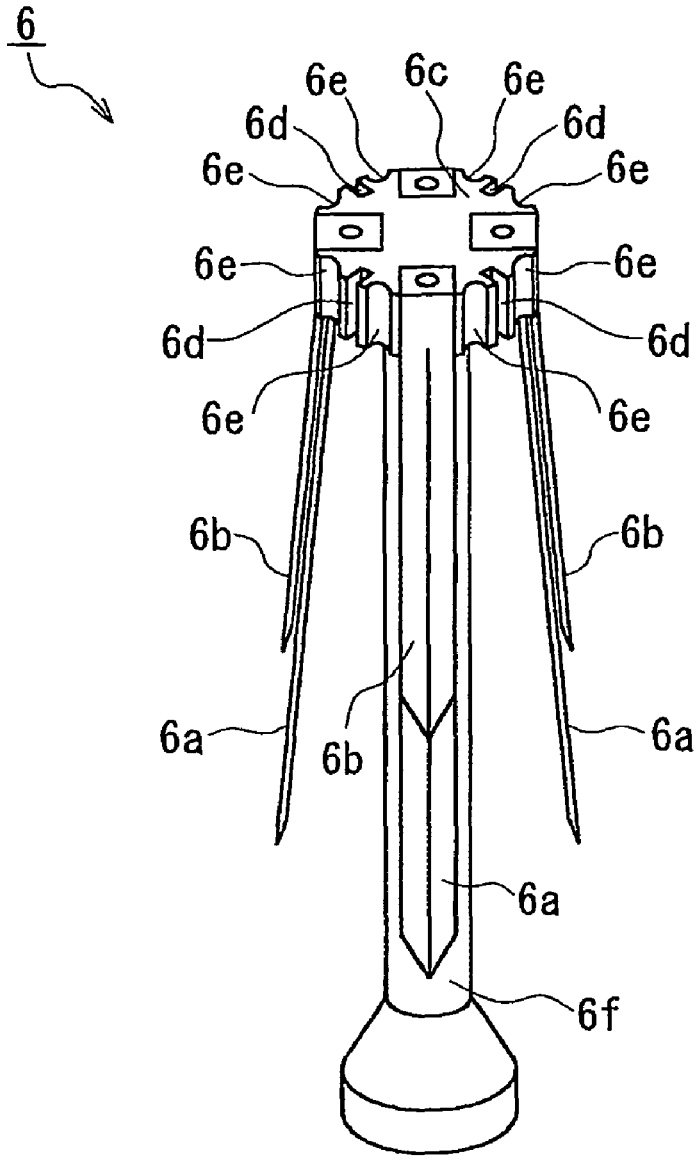
FIG. 5 is a perspective view showing a core assembly mounted on a coupling pile which constitutes the pile as disclosed in FIG. 1.

A core assembly 6 shown in FIG. 4 is for mounting within the leading pile 2, and a core assembly 6 shown in FIG. 5 is for mounting within the coupling pile 3. The core assembly 6 comprises 4 pairs of wedge members 6*a*, 6*b*, and a movable base member 6*c*. The core assembly 6 for mounting within the coupling pile 3 further comprises a central striking member 6*f*. The wedge members 6*a* are designed to be longer than the wedge members 6*b*. This feature corresponds to the arrangement of the openings 2*a*, 2*b*, 3*a*, 3*b* formed at different positions on the leading pile 2 and the coupling pile 3. Each pair of the wedge members 6*a*, 6*b* are placed at every 90° angle on the movable base member 6*c*, and the length of the wedge members 6*a*, 6*b* of the adjacent pairs in circumferential direction are designed differently. This is to correspond to the arrangement that the openings 2*a*, 2*b*, 3*a*, 3*b* adjacent in circumferential direction are alternately positioned with one another The movable base member 6*c* is formed with guide grooves 6*d* to guide the core assembly 6 along the guide rails 4 within the leading pile 2 and the coupling pile 3. Of course, the guide grooves 6*d* are formed at places corresponding to where the guide rails 4 are arranged. The movable base member 6*c* is further comprising a plurality of cement fluid inlets 6*e* which provide inlets for the cement fluid to be poured in. The central striking member 6*f* of the core assembly 6 mounted to the coupling pile 3 is fixed to the center of the movable base member 6*c* with one end detachable thereto. This means that the core assembly 6 in FIG. 5 is the core assembly 6 in FIG. 4 provided with the central striking member 6*f*. At the center of the movable base member 6*c*, a female thread which is not depicted in the drawing is formed, and a male thread formed at one end of the central striking member 6*f* engages thereto. The diameter of one end of the central striking member 6*f* is designed to be larger than the other parts. Further, the length of the core assembly 6 including the central striking member 6*f* is designed to be the same as the length of the leading pile 2 and the coupling pile 3.

After fixing each of the guide rails 4 onto the inner wall of the pile body for example by welding, a pointed leading member 5 shaped as cone or pyramid is equipped and fixed to the lower end of the leading pile 2.

Now the details of the pointed leading member 5 will be described.

The pointed leading member 5 is made from steel, and it is a conical component arranged at one end of the pile assembly 1, in other word to the lower end of the leading pile 2. The pointed leading member 5 is provided with an engaging part 5*a*, and it is mounted to the leading pile 2 by engaging said engaging part 5*a* within the leading pile 2 (refer FIG. 6). The engaged boundary is welded after mounting, and thus pointed leading member 5 is fixed to the leading pile 2. The pointed leading pile 5 can also be made from materials different from leading pile 2 and coupling pile 3. Further, as long as it corresponds to the shape of the pile body, the pointed leading member 5 can have shapes other than cone, such as pyramid or polyhedral pyramid.

As already mentioned above, the core assembly 6 is assembled to the pile body as guided along the guide rails 4 within the leading pile 2 and the coupling pile 3 that comprise the pile body after arranging the guide rails 4 to the pile body.

More precisely, the core assembly 6 of FIG. 4 mounted within the leading pile 2 is inserted in the pile body first. The movable base member 6*c* of the core assembly 6 is moved along the guide rails 4 via the guide groove 6*d*, and guided within the leading pile 2 and the coupling pile 3 comprising the pile body. Prior to such insertion, the openings 2*a* are banged with a hammer or such from outside to form a slope from inside to outside of about 40°.

Next, the core assembly 5 of FIG. 5 is inserted within the pile body. The wedge members 6*a*, 6*b* are compressed when inserted therein to be slightly opened to outside, which means the tips of each wedge members 6*a*, 6*b* are opened to be greater than the inner diameter of the pile body. Accordingly, the tips in acute angles of the wedge members 6*a*, 6*b* are inserted sliding along the inner wall of the pile body as the core assembly 6 is inserted within the pile body. Finally, the tips of the wedge members 6*a* with longer length are projected out of the 4 openings 2*a* which were pushed open inward in advance. By pushing the movable base member 6*c* again after pushing open the remaining 4 openings 2*b* inward to an angle of about 20°, the tips of the 4 wedge members 6*b* are projected out of the openings 2*b*. This enables the simplification of the assembling of the pile assembly 1.

Figure 6:
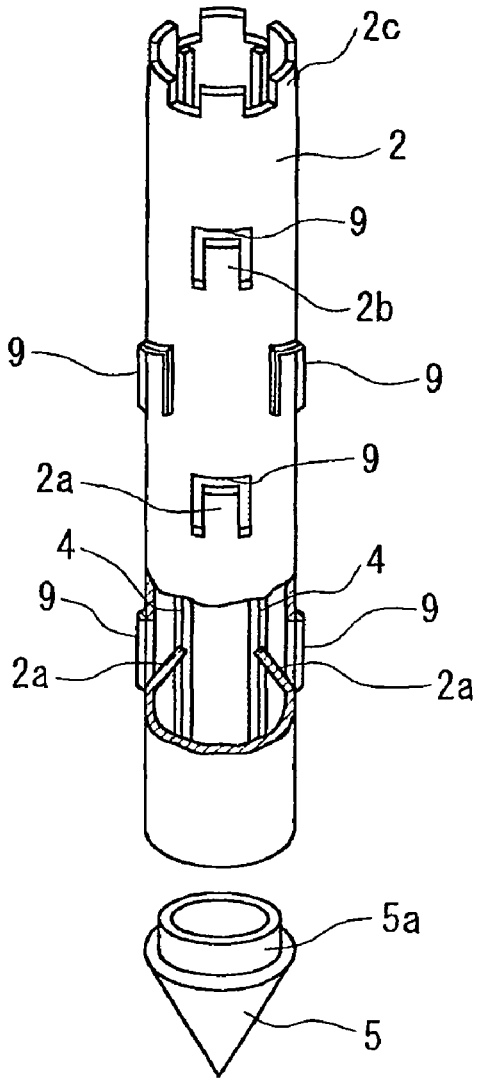
FIG. 6 is a partly cross-sectional perspective view showing a pointed leading member which constitutes the pile assembly as disclosed in FIG. 1 before being fixed thereto.

Similarly, slopes of about 40° from inside to outside are formed by banging the openings 3*a* of the coupling pile 3 from outside with a hammer or such (refer FIG. 6). Upon insertion of the core assembly 6 of FIG. 5 thereafter, the movable base member 6*c* of the core assembly 6 of FIG. 4 is pushed by the central striking member 6*f* of the core assembly of FIG. 5 to reach the very bottom of the leading pile 2. The tips of the wedge members 6*a*, 6*b* of the core assembly 6 of FIG. 4 then reach the position to be projected from the openings 2*a*, 2*b*. On the other hand, the tips of the wedge members 6*a* of the core assembly 6 of FIG. 5 reach the position to be projected from the openings 3*a* in a similar way. Then, the openings 3*b* are opened from exerting force from outside to form slopes of about 20° from inside to outside.

Preferably, the movable base member 6*c* of the core assembly of FIG. 5 is pushed harder to shove in the vertically stacked core assembly 6, 6 within the pile body. This allows the tips of the wedge members 6*b* of the core assembly 6 arranged at the top to reach the position to be projected from the openings 3*b*.

In the next process, or in the process of assembling the pile assembly 1, a leading and excavating spiral blade 7 and a coupling spiral blade 8 is mounted to the periphery of the pile body.

Figure 7:
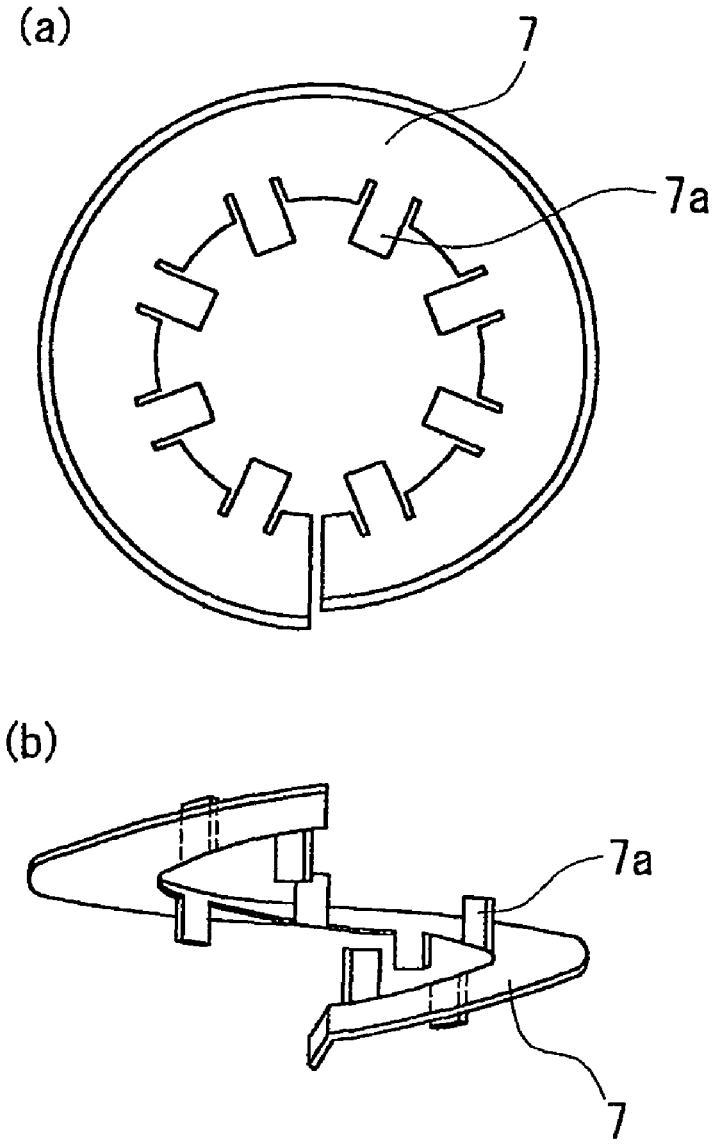
FIG. 7 is an external view showing a leading and excavating spiral blade which constitutes the pile assembly as disclosed in FIG. 1, and (a) is a plane view thereof and (b) is a front view thereof.
Figure 8:
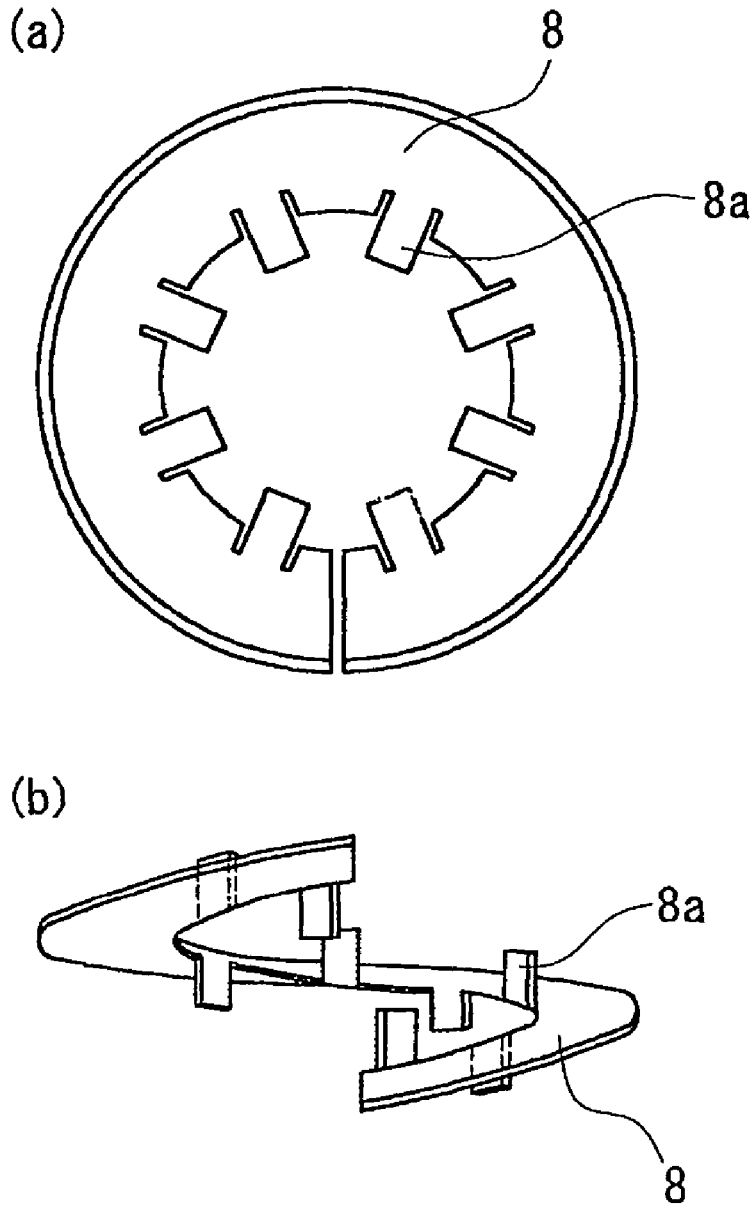
FIG. 8 is an external view showing a coupling spiral blade which constitutes the pile assembly as disclosed in FIG. 1, and (a) is a plane view thereof and (b) is a front view thereof.

The leading and excavating spiral blade 7 (refer FIG. 7) and coupling spiral blade 8 (refer FIG. 8) are spiral blades made by fabricating steel, doughnut-shaped disks. Tip and/or periphery thereof are formed in sharp, cutter-like shape to dig the earth. These components are used for cutting roots of the trees as well as digging the soil. To manufacture these components, a single incision is cut from the outer to the inner circumference of the doughnut-shaped metal plate. Then, by pulling apart vertically the both ends of said incision, the metal plate is shaped in spiral. The inner circumference of the leading and excavating spiral blade 7 and coupling spiral blade 8 are formed to supplement the outer shape of the leading pile 2 to be mounted. On the inner circumference thereof, rectangular juts 7*a*, 8*a* are provided spaced equally apart from one another. The rectangular juts 7*a*, 8*a* are folded alternately to upward and downward directions. By increasing the area of alternately folded rectangular juts 7*a*, 8*a*, temporary jointing as well as positioning when welding the spiral blades 7, 8 onto the pile assembly 1 is simplified, and leads to reduction and simplification of time and expenses. In other word, since the rectangular juts 7*a*, 8*a* are folded alternately to upward and downward directions in use, even when welding onto a cylindrical steel pile, the angle can be adjusted to match the shape of the pile.

The leading and excavating spiral blade 7 and coupling spiral blade 8 can be connected to the pile assembly 1 by welding and such. This allows a stronger and easier attachment to the leading pile 2. The present invention also includes rectangular juts 7*a*, 8*a* to be formed in circular or polygonal shapes.

As the leading and excavating spiral blade 7 functions to aid the insertion of the pile assembly into the earth, it is arranged adjacent to the pointed leading member 5. More precisely, it is fixed to the tip of the leading pile 2. The angles of the leading and excavating spiral blade 7 and coupling spiral blade 8 with the respective rectangular juts 7*a*, 8*a* alternately folded upward and downward are adjusted to match the rotary insertion angle. Then they are fixed onto the side of the leading pile 2 by welding.

The present invention includes providing a locking member to mechanically fix the components instead of welding the components. In the present embodiment, a single coupling spiral blade 8 is connected to the leading and excavating spiral blade 7, but the coupling spiral blade 8 can be disconnected with the leading and excavating spiral blade 7 or a plurality of the coupling spiral blade 8 can be connected thereto in the present invention.

Now, a method for fixing the guide rails 4 employing the magnet cross gauge 40 upon splicing together the leading pile 2 and the coupling pile 3 with the core assembly 6 assembled within respectively in advance will be described.

Figure 2:
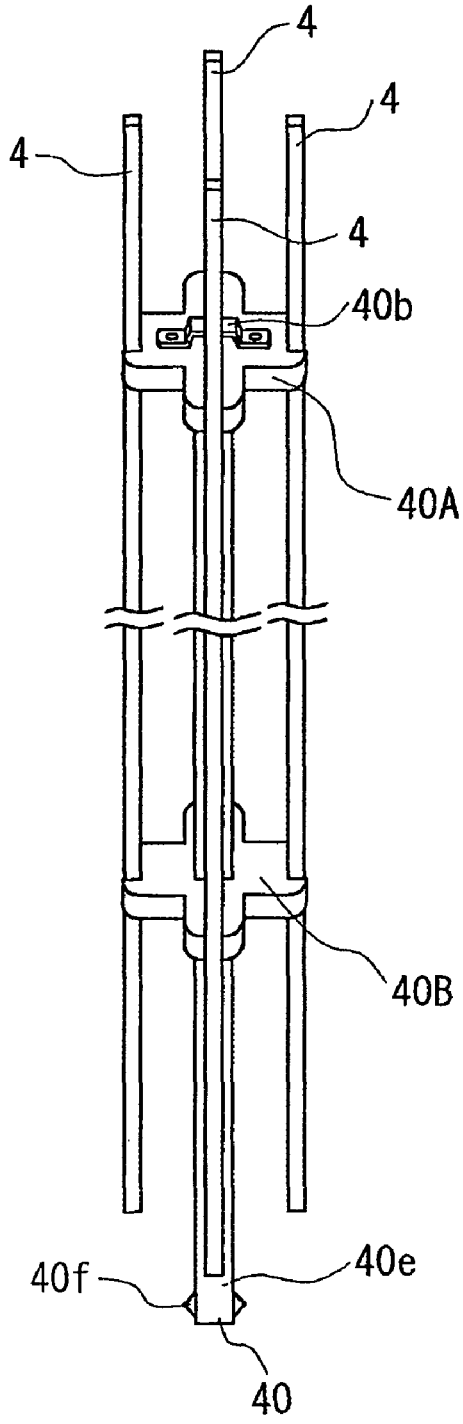
FIG. 2 is a perspective view showing the first embodiment of a magnet cross gauge related to the second invention of the present application.

In a similar way as mentioned above, 4 guide rails 4 are assembled to the magnet cross gauge 40 as the leading pile 2 is set up (refer FIG. 2). The length of the 4 guide rails 4 is to be approximately the same length as the pile body of the pile assembly 1. Then, with said state maintained, the 4 guide rails 4 are inserted within the pile body in places not matching where the openings 2*a*, 2*b*, 3*a*, 3*b* are formed. Each guide rails 4 are welded onto necessary spots of the inner wall of the pile body in such state. Lastly, the magnet cross gauge 40 is removed from the pile body by pulling it by the handle 40*b*. With such method, it becomes possible to fix the guide rails 4 onto the inner wall of the pile body precisely and without difficulty. The guide rails 4 are welded to the coupling pile 3 in a similar manner. The leading pile 2 and the coupling pile 3 with the guide rails 4 installed are manufactured as above, and they are fixed together by welding and such in the factory or at the construction site. From above processes, the pile assembly 1 is manufactured. The incisions for the openings 2*a*, 2*b*, 3*a*, 3*b* can be formed at any time either before or after any of the above steps in such case as well. Further, the pointed leading member 5 can be fixed to the lower end of the leading pile 2 at any time as long as the guide rails 4 are already arranged within the inner wall of the leading pile 2.

Figure 9:
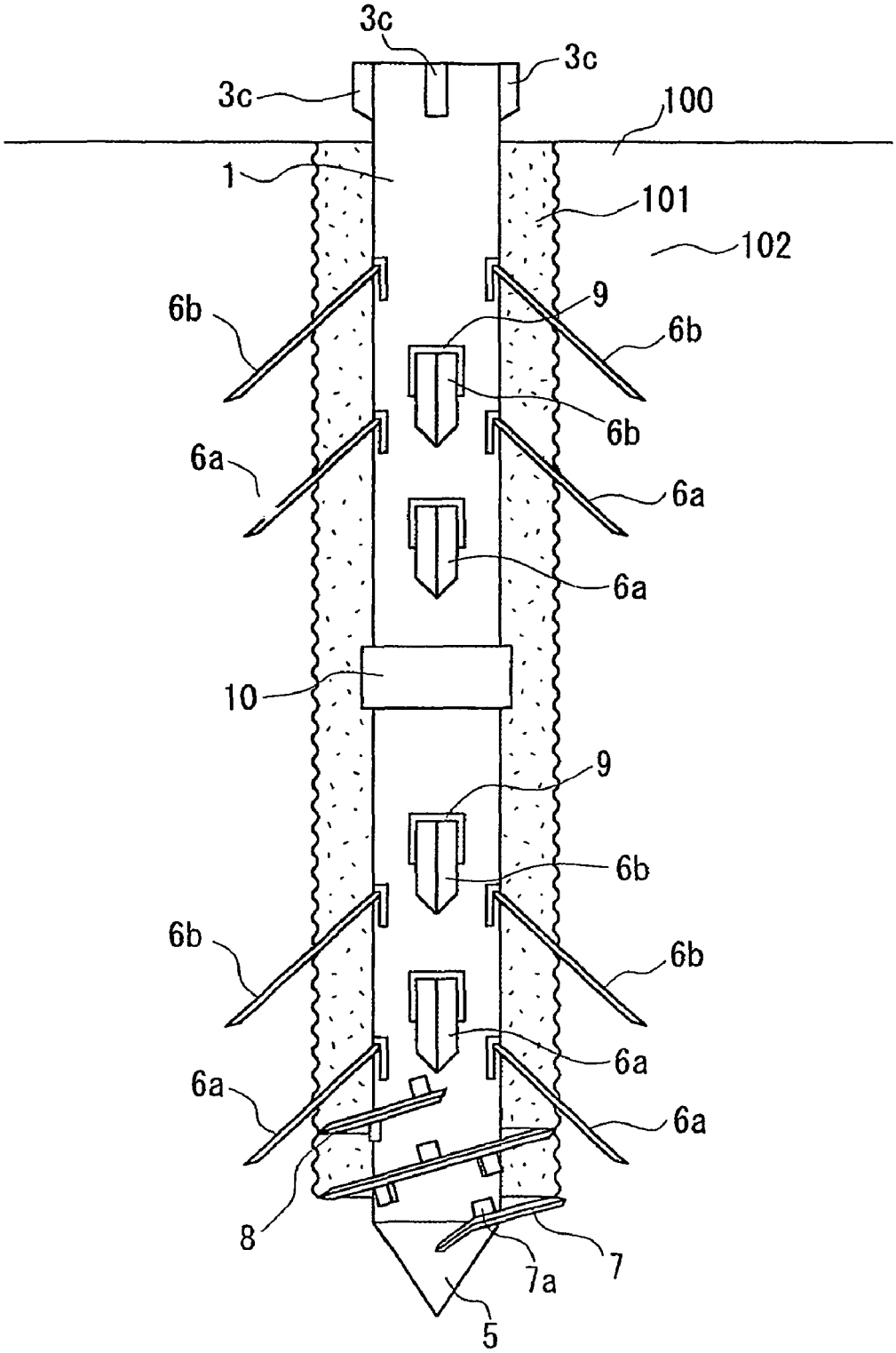
FIG. 9 is a pattern diagram showing the pile assembly as disclosed in FIG. 1 in an actual usage state.

An assembling process and composition of the first embodiment of the pile assembly related to the present invention are described above. Now, the use of such pile assembly will be described with reference to FIG. 9.

Firstly, the pile assembly related to the present invention is rotationally pierced into the ground 100 until reaching the predetermined depth with a rotary pile penetrating tool which is not shown in the drawing. The soil of outer circumferential area of the pile assembly 1 becomes soft and weak dug and mixed with the leading and excavating spiral blade 7 and coupling spiral blade 8, while the pile assembly 1 is penetrated to reach the predetermined depth. In other words, as the projected area of the leading and excavating spiral blade 7 and coupling spiral blade 8 is greater than the diameter of the leading pile 2 and the coupling pile 3, the outer area of the steel pipe dug and mixed from the rotary penetration of these spiral blades becomes soft and weak.

Figure 10:
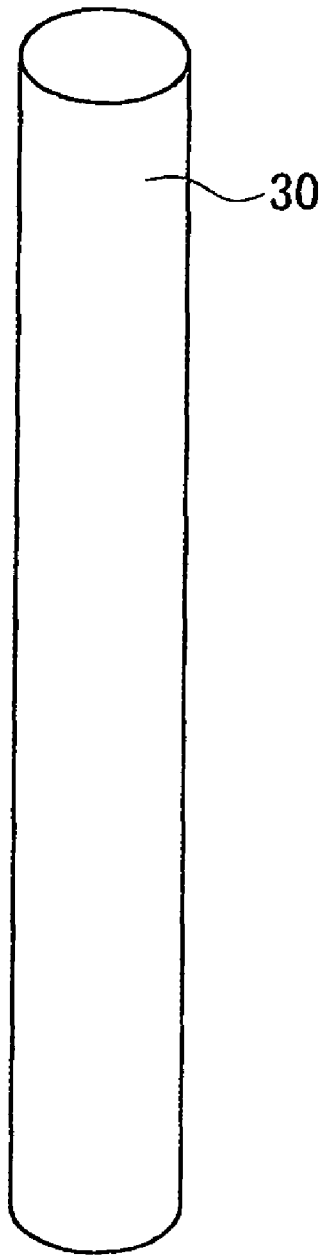
FIG. 10 is a perspective view showing a steel bar in an unprocessed state used for projecting wedge members out from the pile assembly of the present invention.

With the pile assembly 1 buried to the predetermined depth in the ground 100, extrusive steel bar 30 as shown in FIG. 10 is inserted inside the pile assembly 1 from the upper end. With such process, the wedge members 6*a*, 6*b* are projected from the pile body as the core assemblies 6, 6 are pushed down with the force exerted from above. The wedge members 6*a*, 6*b* thrust through the weakened mixed soil 101, and reach the firm soil 102 (refer FIG. 9). That is to say that the 16 wedge members 6*a*, 6*b* contained within the pile assembly 1 are projected from the openings 2*a*, 2*b*, 3*a*, 3*b* to thrust through the weak soil to the firm soil 102 with the force exerted by the extrusive steel bar 30. As a result, the pile assembly 1 becomes stable as a rooted tree to the forces exerted from all 360° direction, and the spiral blades function also as effective supporting components for the pile assembly 1 to be an anti-seismic pile to tolerate earthquakes.

On the other hand, there are empty spaces within the pile assembly 1 in a state being built in the ground. Hence, cement fluid can be poured into the pile assembly 1 via cement fluid inlets 6*e* of the movable base member 6*c* to solidify within the pile assembly 1, by which process more stable, safe and strong pile assembly 1 can be provided.

Now, the second embodiment of the pile assembly 1 related to the present invention will be described with reference to FIG. 11, 12 and 15. Regarding components similar to that used in the first embodiment, the same numberings are also used in the drawings of the second embodiment.

The pile assembly 1 of the second embodiment is substantially the same as the pile assembly 1 of the first embodiment as already described above. Therefore, components that differ from the first embodiment are described first.

The pile assembly 1 of the second embodiment has the length of 4 to 5 m. Wedge members 6*a*, 6*b* are formed wide and thick, which makes them impossible to be bent.

Figure 11:
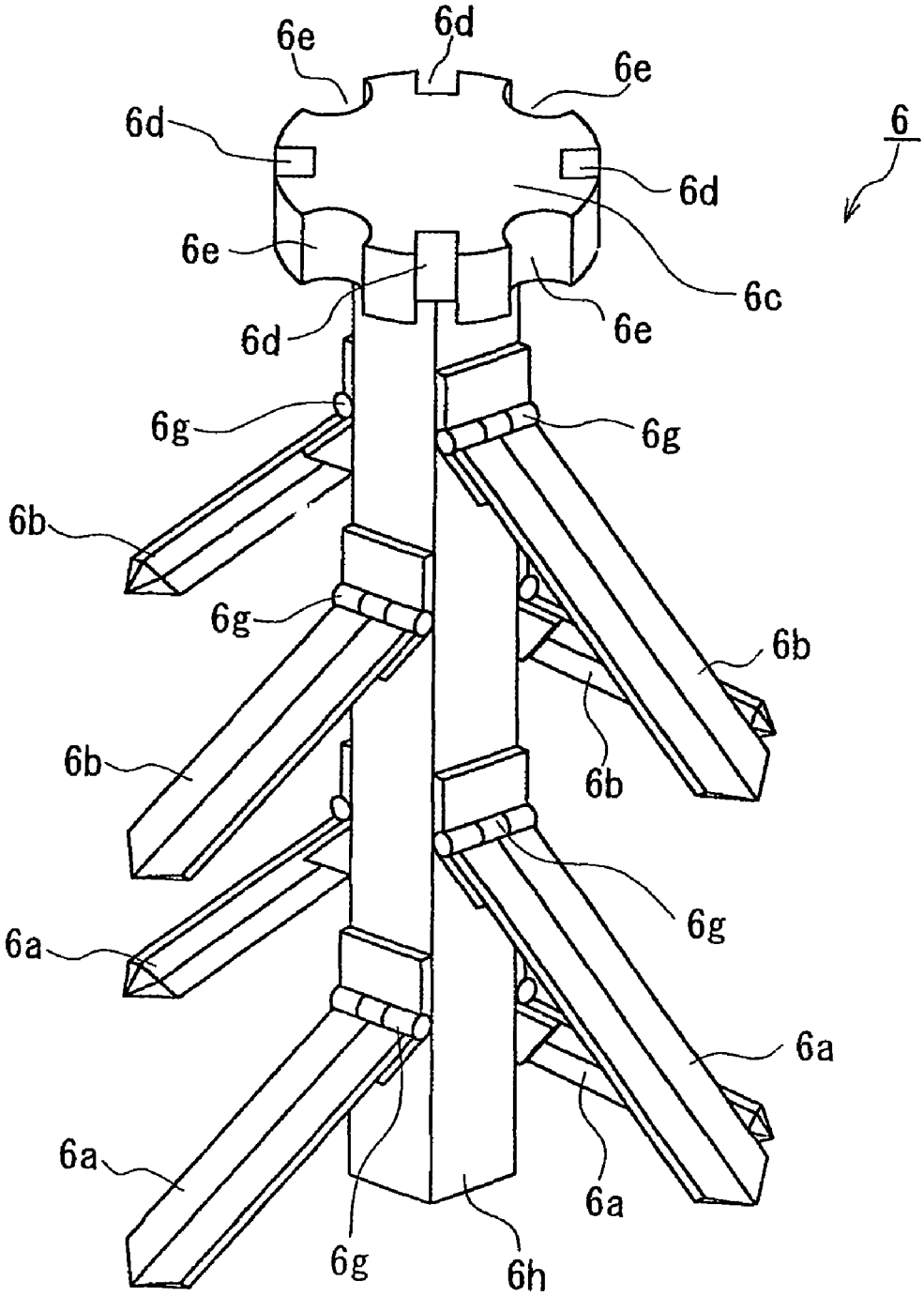
FIG. 11 is a perspective view showing a core assembly mounted to a leading pile of the second embodiment of the pile assembly related to the first invention of the present application.
Figure 12:
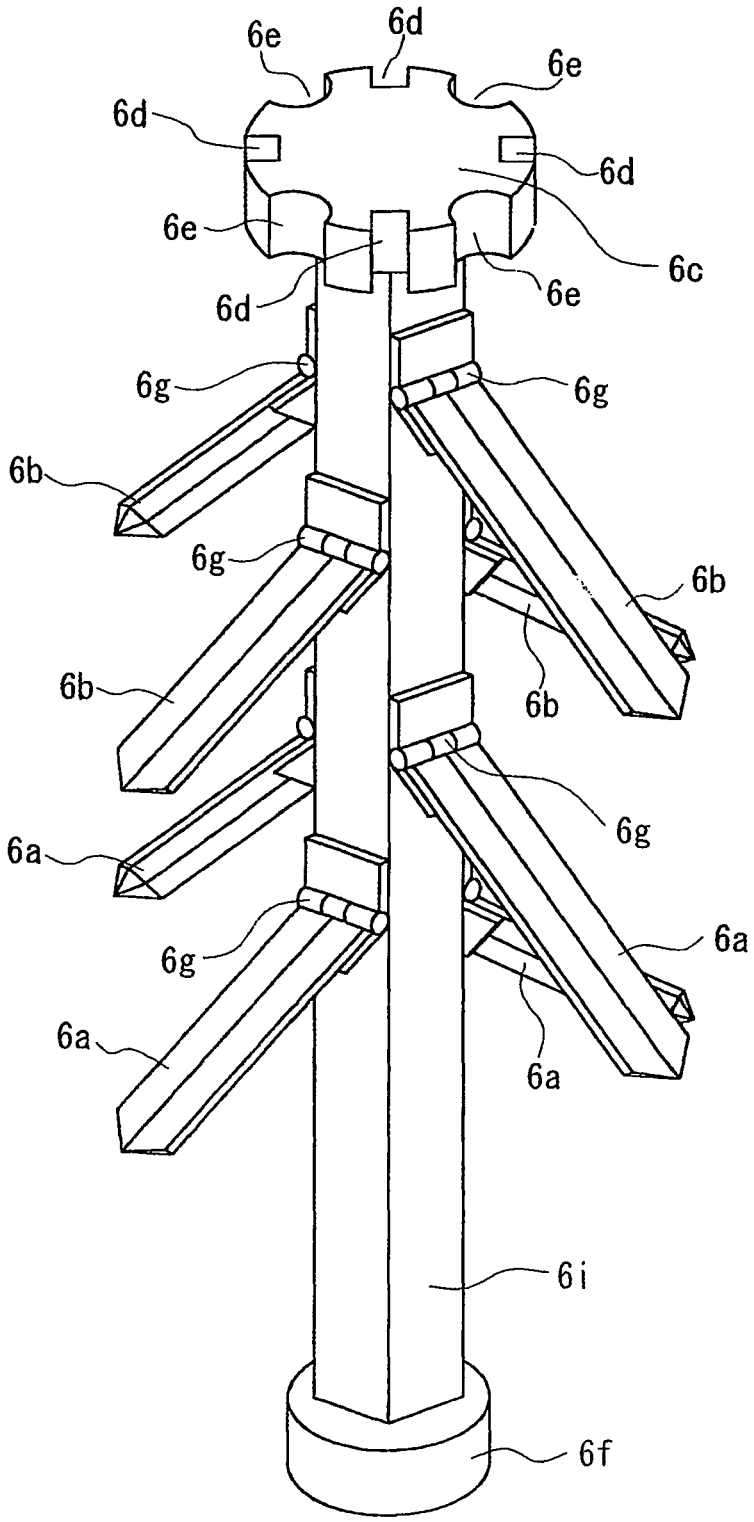
FIG. 12 is a perspective view showing a core assembly mounted to a coupling pile of the second embodiment of the pile assembly related to the first invention of the present invention.

In FIGS. 11 and 12, a core assembly 6 to be arranged within the pile assembly 1 of the second embodiment is disclosed. The core assembly 6 in FIG. 11 is to be mounted within the leading pile 2 whereas the core assembly 6 in FIG. 12 is to be mounted within the coupling pile 3.

The core assembly 6 is provided with 4 pairs of wedge members 6*a*, 6*b*, a movable base member 6*c*, hinges 6*g* and a linking pillar 6*h*. One end of the linking pillar 6*h* is fixed to the center of the base plane of the movable base member 6*c*. The wedge members 6*a*, 6*b* are mounted to the linking pillar 6*h* by the hinges respectively. Hence, it is possible to change the angles of the wedge members 6*a*, 6*b* to the linking pillar 6*h* at the respective hinged point. As for the core assembly 6 mounted within the coupling pile 3, a central striking member 6*f* is provided at the tip of the linking pillar 6*i*. The wedge members 6*a* are formed in a same length as the wedge members 6*b*. However, the wedge members 6*a* and wedge members 6*b* are arranged on the linking pillar 6*h* or linking pillar 6*i* at different level with one another. More specifically, these linking pillars are rectangular components with the wedge members 6*a* and 6*b* arranged vertically at the 4 sides thereof with predetermined space in between one another. Such feature corresponds to the arrangement of the openings 2*a*, 2*b*, 3*a*, 3*b* formed at different level on the leading pile 2 and the coupling pile 3.

The movable base member 6*c* is formed with guide grooves 6*d* to guide the core assembly 6 along the guide rails 4 within the leading pile 2 and the coupling pile 3. Of course, the guide grooves 6*d* are formed at places corresponding to where the guide rails 4 are arranged. The movable base member 6*c* further comprises a plurality of cement fluid inlets 6*e* which provide inlets for the cement fluid to be poured in.

The central striking member 6*f* of the core assembly 6 mounted to the coupling pile 3 is fixed to one end of the linking pillar 6*i*. It is possible to prepare the core assembly 6 in FIG. 12 from the core assembly 6 in FIG. 11 mounted with the central striking member 6*f*. Such mounting can be done, for example, by forming a female thread at the center of the linking pillar 6*i*, and engaging a male thread formed at the center of the central striking member 6*f* thereto. The linking pillar 6*i* and the central striking member 6*f* can be made as a single part. Further, the diameter of the linking pillar 6*i* is designed to be greater than the width of the central striking member 6*f*. Further, the length of the core assembly 6 including the central striking member 6*f* is designed to be approximately the same as the length of the leading pile 2 and the length of the coupling pile 3.

The cross-sectional shape of the liking pillar 6*h* is not limited to rectangle in the present invention, which means that the cross-sectional shape of the linking pillar 6*h* can be circular or polygonal, such as pentagonal and hexagonal. Further, the present invention also includes the length of the core assembly 6 including the central striking member 6*f* to be different from the length of the leading pile 2 and the coupling pile 3.

Figure 13:
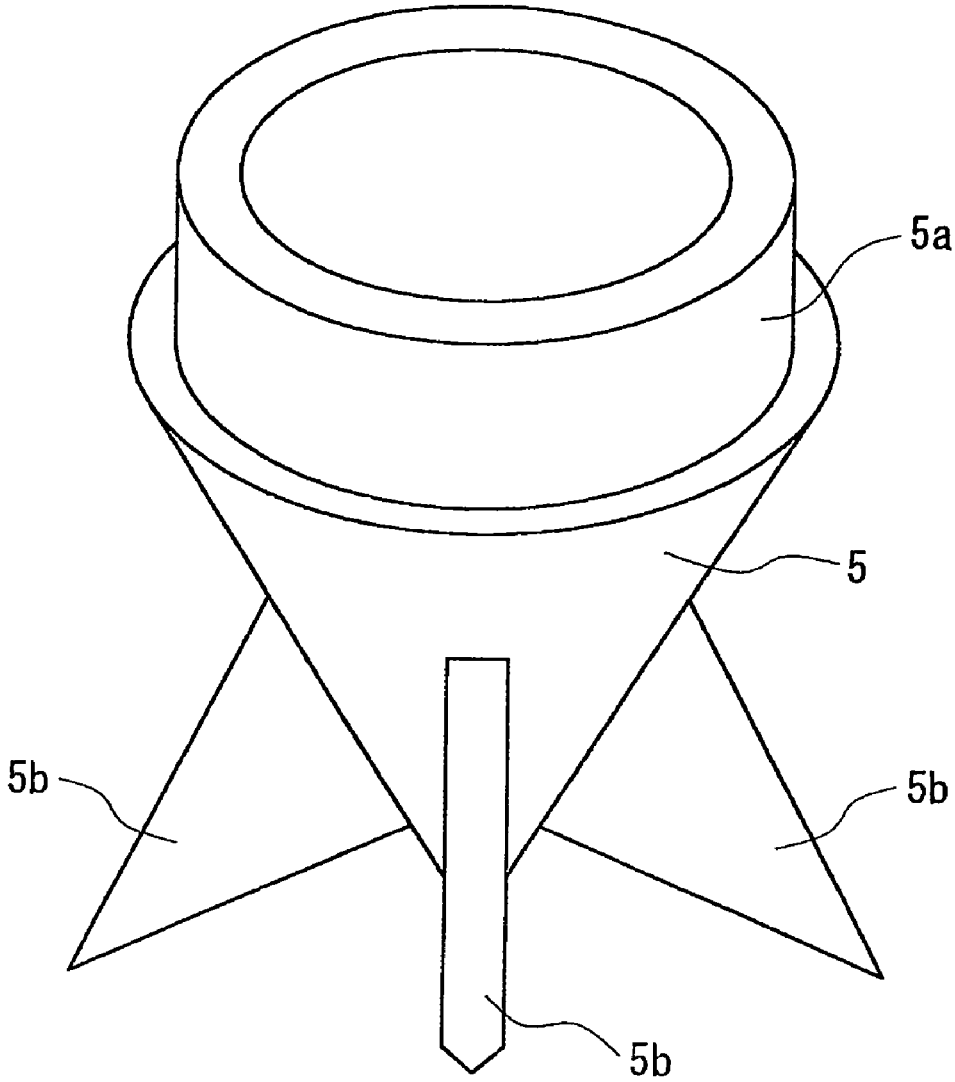
FIG. 13 is a perspective view showing a pointed leading member employed in the second embodiment of the pile assembly related to the first invention of the present application.

Next, a pointed leading member 5 used in the pile assembly 1 of the second embodiment will be described with reference to FIG. 13. The pointed leading member 5 in the second embodiment is provided with a plurality of excavating components 5*b*. With this excavating components 5*b* and the above mentioned spiral blades such as the leading and excavating spiral blade 7 and the coupling spiral blade 8, it is easier to bury the pile assembly 1 of the present invention in the ground. However, the present invention does not limit the pile assembly 1 to be provided with both excavating component 5*b* and the spiral blades, such as the leading and excavating spiral blade 7 and the coupling spiral blade 8.

Figure 14:
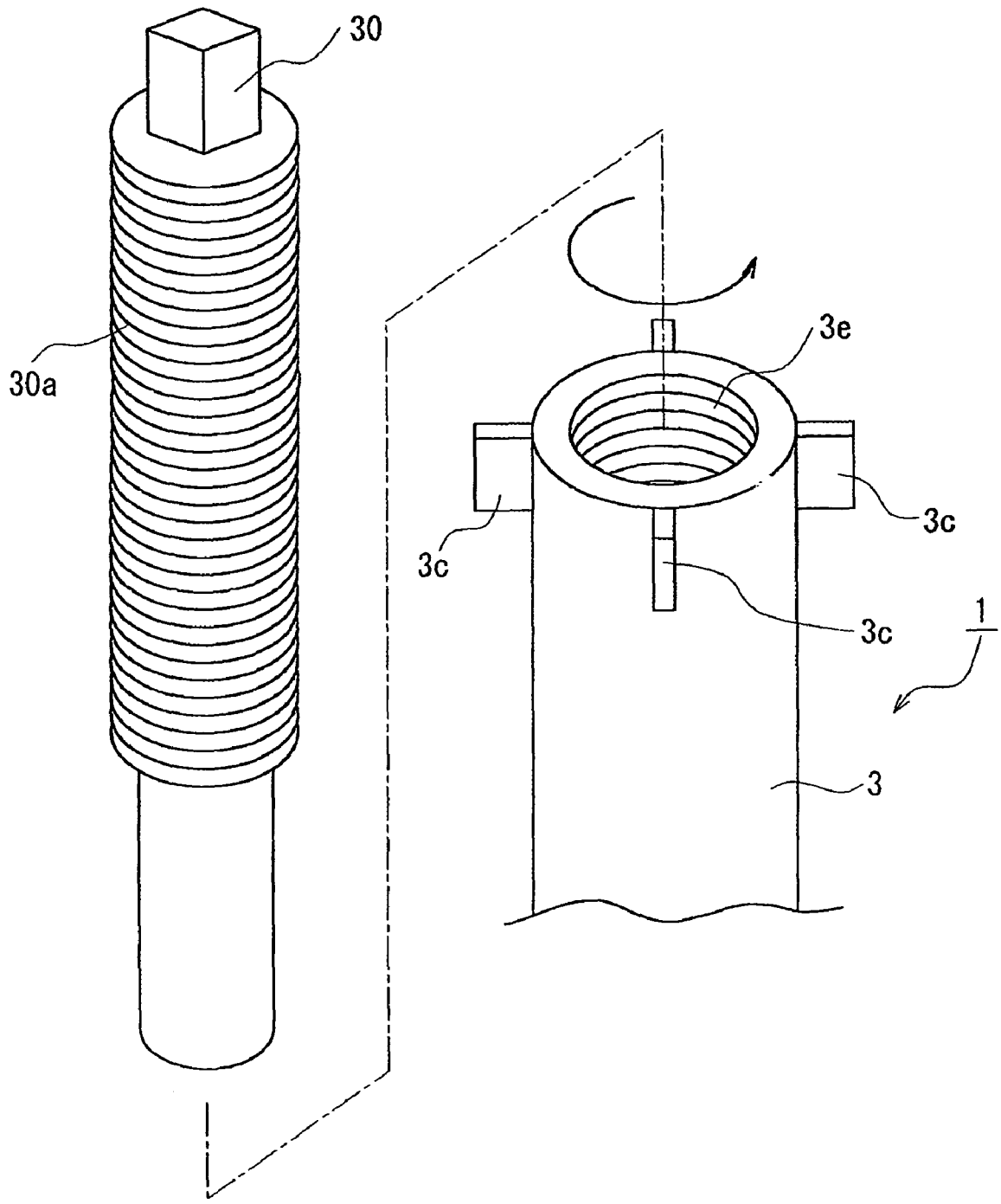
FIG. 14 is a pattern diagram for explaining an assembling of a coupling pile and an extrusive steel bar in the second embodiment of the pile assembly related to the first invention of the present application.

Now, an extrusive steel bar 30 to project the wedge members 6*a*, 6*b* out of the pile assembly 1 of the second embodiment will be described with reference to FIG. 14.

The extrusive steel bar 30 is a multistage component with the outer surface threaded thereof to form a male thread section 30*a*. On the other hand, the coupling pile 3 has the upper inner section threaded to form a female thread section 3*e*. By engaging the male thread section 30*a* to the female thread section 3*e*, the extrusive steel bar 30 can be inserted as rotated within the coupling pile 3. However, since the guide rails 4 are mounted to the middle of the coupling pile 3, the female thread section 3*e* is to be provided only at the upper section of the coupling pile 3. In other words, the length of the guide rails 4 are designed to be shorter than the length of the leading pile 2 and the coupling pile 3 spliced together. Although not shown in the drawings, the extrusive steel bar 30 is designed as multistage, so that upon insertion of the extrusive steel bar 30 to the predetermined depth within the coupling pile 3, the bar can be extended by adding another bar. With such feature, the core assembly 6 can be appropriately pressed into the coupling pile 3.

Above are the differences between the pile assembly 1 of the first embodiment and the above-mentioned pile assembly 1 of the second embodiment.

Now the projection of the wedge members 6*a*, 6*b* after the pile assembly 1 of the second embodiment is pierced into the ground 100 will be described with reference to FIG. 15.

Figure 15:
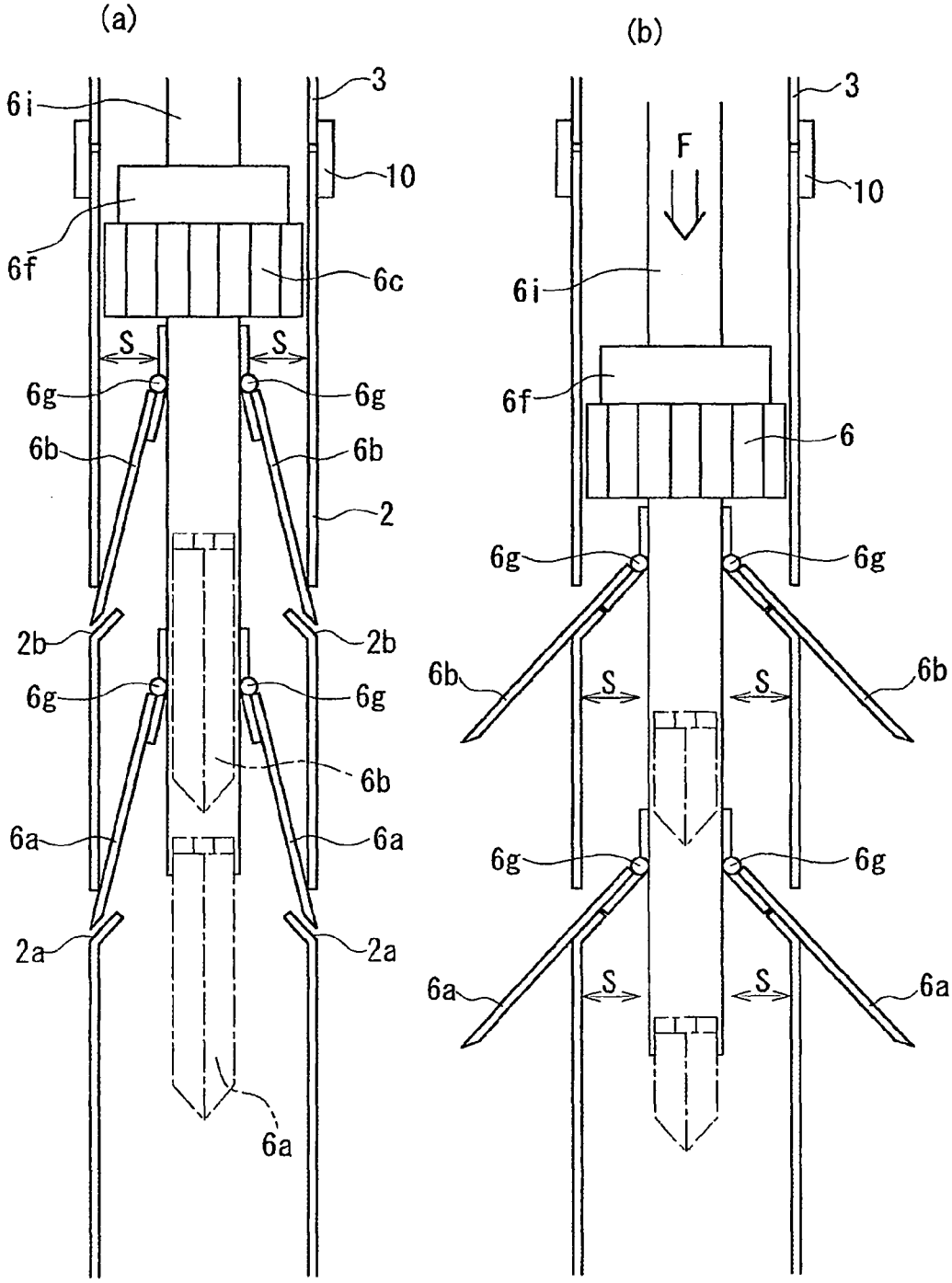
FIG. 15 is an explanatory view mainly showing a core assembly of a leading pile in the second embodiment of the pile assembly related to the first invention of the present application, and (a) is an end view showing a state prior to projection of wedge members, and (b) is an end view showing a state after projection of wedge members.

FIG. 15(*a*) is a cross-sectional view of the pile assembly 1 of the second embodiment, mainly showing the core assembly 6 of the leading pile 2 in a state before projection of the wedge members 6*a*, 6*b*. FIG. 15(*b*) shows a state after projection of the wedge members 6*a*, 6*b* in FIG. 15(*a*). The leading pile 2 is mainly disclosed in FIG. 15, but it is the same with the coupling pile 3.

First of all, the pile assembly 1 will be described. There are large spaces S formed in between the inner wall of the leading pile 2 and the central striking member 6*h* of the core assembly 6. Accordingly, a stronger pile assembly 1 can be provided by filling the cement fluid therein. As shown in FIG. 15(*a*), in the assembled state of the pile assembly 1, the wedge member 6*a*, 6*b* are arranged at positions able to be projected from the openings 2*a*, 2*b*. At the upper end of the leading pile 2, the coupling pile is fixed thereto, and the core assembly 6 of the coupling pile 3 is situated on top of the core assembly 6 of the leading pile 2. In such state, the central striking member 6*f* of the core assembly of the coupling pile 3 comes in contact with the movable base member 6*c* of the core assembly of the leading pile 2.

Upon inserting the extrusive steel bar 30 from the upper end of the pile assembly 1 to be engaged thereto in a state shown in FIG. 15(*a*), a great torque is produced with its rotary movement. Hence the downward force F shown in the drawing is exerted to the core assembly 6 situated at the top, and both top and below core assembly 6 are pushed downward simultaneously. As a result, the hinges 6*g* open to project the wedge members 6*a*, 6*b* connected thereto out of the pile assembly 1 as shown in FIG. 15(*b*) without them being bent.

In the present embodiment, the wedge members 6*a*, 6*b* posses 3 characteristics as mentioned herein below compared to the first embodiment. First characteristic is that the wedge members 6*a*, 6*b* are mounted to the sides of the strong and flat-surfaced linking pillar 6*h* of the core assembly 6. This enables a comparably large force to be transmitted to the wedge members 6*a*, 6*b*. Second characteristic is that the wedge members are mounted to the linking pillar 6*h* of the core assembly 6 by components which can change the angles thereof, such as hinges 6*g*. This enables a straight penetration of the wedge members 6*a*, 6*b* into the soil without being bent. Third characteristic is that the wedge members are formed in wide and thick shape from a material which cannot be bent. Even when there is a large space S in between the inner wall of the leading pile 2 and the central striking member 6*h* of the core assembly 6, the wedge members 6*a*, 6*b* will not bend due to this characteristic.

In the pile assembly 1 of the present embodiment, 4 guide rails 4 are fixed at once to the precise desired position on the inner wall of the steel pipe using the above mentioned magnet cross gauge 40. On the other hand, since the guide grooves 6*d* are formed on the movable base member 6*c* of the core assembly 6 to be mounted within the pile assembly 1, by retaining the guide rails 4 therein, it is possible to reduce the time consumed in the conventional assembling process which was extremely difficult. Hence, works previously required a pair of workmen are simplified to works requiring only 1. Further, with the wedge members 6*a*, 6*b* projected and rooted from the pile assembly 1, the sidewall of pile assembly 1 is supported by a plurality of the wedge members 6*a*, 6*b*, as the pointed leading member 5 is supported by the spiral blades. From such feature, the pile assembly 1 is maintained in a state strongly rooted within the earth.

Further, the pile assembly 1 of the present embodiment has a simpler composition than the above mentioned pile assembly 1 of the first embodiment. In the pile assembly 1 of the first embodiment, the wedge members 6*a*, 6*b* have to bend in order to be projected out of the pile assembly 1, whereas in the pile assembly 1 of the present embodiment, the wedge members 6*a*, 6*b* do not necessary have to bend in order to be projected. Therefore, it is possible to employ the pile assembly 1 of the first embodiment as a smaller pile assembly, and that of the second embodiment as a larger pile assembly. However, the present invention does not limit the scope of invention to the above mentioned first or second embodiments.

(Possibility for the Industrial Use of the Invention)

According to the pile assembly of the present invention as described herein above, with the guide rails mounted thereon, swift and easy assembling of the pile assembly becomes possible. Further, with the employment of magnet cross gauge, as the guide rails can be maintained in appropriate position with respect to one another, mounting of the guide rails within the pile assembly becomes easier. It is further characterized to be mass produced, being simplified with repeated modification and to be offered in a low cost.

What is claimed is:

1. A pile assembly employed in engineering and construction works comprising a pile body formed in a hollow column with an interior hollow space defined by inner surfaces of columnar sidewalls extending lengthwise in the direction of a longitudinal axis of the pile body, and a plurality of openings provided at intervals through the sidewalls thereof, wherein the inner surfaces of the sidewalls have a given number of guide rails fixed thereto which are spaced at equal intervals circumferentially around the sidewalls and extending in parallel with the longitudinal axis thereof, and a core assembly having a movable base member mounting a plurality of longitudinally extending wedge members ending with tips thereon mounted within said pile body, wherein said movable base member has a plurality of guide grooves the same number as guide rails which are spaced at equal intervals circumferentially around a periphery of the base member and are aligned in parallel with the longitudinal axis and adapted to engage the respective guide rails extending axially lengthwise in the interior hollow space of the pile body for allowing a guiding of movement of said core assembly within said pile body, wherein said core assembly is guided via said guide grooves engaged with the guide rails for movement within the interior hollow space of the pile body to appropriately lead the tips of said wedge members to engage said openings and be projected out from the columnar sidewalls of said pile body, wherein said pile assembly is formed by splicing together the pile body divided in 2 or more portions, with said core assembly provided in each of said divided pile body portions, and wherein said guide rails are provided to extend across the length of each of said divided pile body portions respectively.

2. A pile assembly as defined in claim 1 in which said guide rails are provided with a length that extends across the lengths of said divided pile body portions spliced together to form within said pile assembly.

3. A pile assembly as defined in claim 1 in which said openings are formed as incised apertures opened by exertion of outer force, wherein at least the lower edge portions of tongue-shaped pieces of said opened apertures are connected to said pile body, while said tongue-shaped pieces constitute slopes.

4. A pile assembly as defined in claim 1 and further provided with a spiral blade for digging soil on an outer wall of a lower end thereof for facilitating said pile assembly to be penetrated in the earth.

5. A pile assembly as defined in claim 1 and further provided with a pointed leading member with excavating components at a lower end thereof.

6. A pile assembly as defined in claim 1 in which said wedge members are formed to have lengths different from the lengths of wedge members adjacent thereto.

7. A pile assembly as defined in claim 1 in which the cross-sectional shape of said pile body is designed to be either circular or rectangular.

8. A pile assembly as defined in claim 1 in which said wedge members are mounted on said core assembly at corresponding positions with said openings by components capable of changing angles, such as hinges.

9. A magnet cross gauge provided with magnets employed in manufacturing of a pile assembly comprising a pile body formed in a hollow column with an interior hollow space defined by inner surfaces of columnar sidewalls extending lengthwise in the direction of a longitudinal axis of the pile body and with a plurality of openings provided on the sidewalls thereof, and a core assembly having a plurality of wedge members ending with tips thereon mounted within said pile body, wherein a given number of metal guide rails are to be attached to the sidewalls extending axially lengthwise in the interior hollow space of the pile body for allowing a guiding of movement of said core assembly within said pile body, and wherein said core assembly is guided via said guide rails to appropriately lead the tips of said wedge members to said openings, wherein said magnet cross gauge has recesses and respective magnets adjacent thereto of the same number as guide rails to be attached to the sidewalls which are spaced at equal intervals circumferentially around a periphery of the magnet cross gauge and are aligned in parallel with the longitudinal axis and adapted to retain the guide rails respectively in the recesses by magnetic force of the adjacent magnets to allows an insertion of said guide rails in said pile assembly while maintaining said guide rails in parallel with respect to one another, wherein said guide rails are can then be fixed to the inner surfaces of the sidewalls of the interior hollow space of said pile body in parallel with respect to one another, and said magnet cross gauge capable of then being removed from said pile while said guide rails remain fixed to the inner wall of said pile body thereafter.

10. A magnet cross gauge as defined in claim 9 further comprising a first magnet cross gauge member provided with a plurality of recesses on a periphery thereof enabling said guide rails to be held therein, magnets mounted adjacent to said recesses, and a handle attached on one side of said first magnet cross gauge member;

bar members fixed to said first magnet cross gauge member; and a second magnet cross gauge member mounted to be movable or unmovable to said bar members while provided with a plurality of recesses on periphery thereof enabling said guide rails to be held therein and magnets mounted adjacent to said recesses.

11. A method for fixing guide rails within a pile body by employing a magnet cross gauge provided with magnets employed in manufacturing of a pile assembly comprising a pile body formed in a hollow column with a plurality of openings provided on a sidewall thereof, and a core assembly having a plurality of wedge members mounted within said pile body, wherein a guide rail allowing the guidance of said core assembly is provided within said pile body, and wherein said core assembly is guided via said guide rail to appropriately lead the tips of said wedge members to said openings, wherein said magnet cross gauge allows an insertion of a plurality of said guide rails in said pile assembly while maintaining said guide rails in parallel with respect to one another, and is further capable of fixing said guide rails to an inner wall of said pile body in parallel with respect to one another, and being removed from said pile while said guide rails remain fixed to the inner wall of said pile body thereafter, said method comprising a step to maintain the plurality of said guide rails in parallel with respect to one another by employing said magnet cross gauge;

a step to determine a position of said guide rails within said pile body after inserting said guide rails maintained in parallel to one another within said pile body;

a step to fix each of said guide rails to the inner wall of said pile body; and a step to remove only said magnet cross gauge from within said pile body while having said guide rails remain fixed to the inner wall of said pile body.

12. A method for fixing said guide rails as defined in claim 11 within said pile body in which said pile body is comprised of the pile body divided in 2 or more pile body portions, wherein said method for fixing said guide rails within said pile body is provided with a step performed prior thereto to splice together said pile body portions.

13. A method for fixing said guide rails as defined in claim 11 within said pile body in which said pile body is comprised of the pile body divided in 2 or more pile body portions, wherein said method for fixing said guide rails within said pile body is performed to 2 or more pile body portions respectively.

14. A method for manufacturing a pile assembly comprising a pile body formed in a hollow column with an interior hollow space and with a plurality of openings provided on sidewalls thereof, and a core assembly having a plurality of wedge members ending with tips thereon mounted within said pile body, wherein a given number of guide rails are to be provided extending axially lengthwise in the interior hollow space of the pile body for allowing a guiding of movement of said core assembly within said pile body, and wherein said core assembly is guided via said guide rails to appropriately lead the tips of said wedge members to said openings, said method comprising a step to carry said given number of guide rails into the hollow interior space of the pile body and maintain said guide rails at desired equal intervals circumferentially around the periphery of the sidewalls in parallel with respect to one another by employing a magnet cross gauge having respective recesses and adjacent magnets around the periphery thereof for retaining the guide rails therein, a step to fix said guide rails on the inner surfaces of the sidewalls of said pile body either before or after said openings are formed on the sidewall of said pile body, and a step to push the incised sections of the openings inward to form slopes after the incisions are formed, in case the incisions for said openings are not formed in said step to fix said guide rails, and to guide said core assembly provided with the plurality of wedge members with respective tips formed in acute angle within said pile body by employing said guide rails, and to position said core assembly so that the tips of said wedge members are guided by said slopes and placed adjacent to said openings.

15. A method for manufacturing said pile assembly as defined in claim 14 in which said pile body is comprised of 2 or more said pile body portions, wherein said method for manufacturing said pile assembly includes a step to splice together said pile body portions before fixing said guide rails onto the inner wall of said pile body, wherein said step to fix said guide rails onto the inner wall of said pile body is to install said guide rails so as to extend across a plurality of said pile body portions spliced together.

16. A method for manufacturing said pile assembly as defined in claim 14 in which said pile body is comprised of 2 or more said pile body portions, wherein said step to fix said guide rails onto the inner wall of said pile body as well as said step to position the tips of said wedge members to be adjacent to said openings are performed to each of said pile body portions, wherein a step to splice together said pile body portions each provided with said core assembly is performed subsequent thereto.

17. A method for manufacturing said pile assembly as mentioned in claim 14 comprising a step to fix a pointed leading member formed in a shape of cone or pyramid at one end of said pile assembly after performing said steps to fix said guide rails.

* * * * *